United States Patent [19]

Lockwood

[11] 4,383,378

[45] May 17, 1983

[54] SECONDARY DRYER FOR FREE WATER DETECTOR PADS

[76] Inventor: Harry A. Lockwood, 5 Deepwood La., Westport, Conn. 06880

[21] Appl. No.: 239,265

[22] Filed: Mar. 2, 1981

[51] Int. Cl.[3] ..... F26B 15/12

[52] U.S. Cl. ..... 34/68; 34/105; 34/181; 34/206; 34/236; 198/436; 198/795; 432/126; 432/153

[58] Field of Search ..... 432/126, 133, 137, 143, 432/144, 145, 153, 9, 171, 183, 184, 202, 243, 68; 198/747, 436, 442, 795; 53/127, 440, 557; 34/105, 181, 202, 206, 236; 126/299 E, 299 R; 219/400

[56] References Cited

U.S. PATENT DOCUMENTS

| | | | |
|---|---|---|---|
| 1,637,427 | 8/1927 | Riches et al. | 219/400 |
| 1,705,703 | 3/1929 | Baker | 198/795 |
| 2,167,343 | 7/1939 | Bergmann | 198/436 |
| 2,999,579 | 9/1961 | Kostrzewa | 198/795 |

*Primary Examiner*—Larry I. Schwartz
*Attorney, Agent, or Firm*—H. Gibner Lehmann; K. Gibner Lehmann

[57] ABSTRACT

A secondary dryer device comprising a drying oven, for subjecting open containers of water detector pads to a secondary drying operation. The oven has a pair of elongate channels disposed side by side with open, outer-most ends and blind inner-most ends. One channel holds a plurality of containers in single file, whereas the other channel holds a plurality of containers in double file, whereby the dwell time is greatly increased. A transfer structure interconnects the blind ends of the channels to provide transfer of the containers from the narrow channel to the wider channel. A powered pushing device applies force to the containers of the single file, to advance said containers inwardly into the oven, toward the blind end of the channel. The oven has means which provides heat to raise the temperature and expel moisture.

12 Claims, 4 Drawing Figures

SECONDARY DRYER FOR FREE WATER DETECTOR PADS

BACKGROUND

This invention relates to the processing of water detection devices such as small wafers or pads, and more particularly to the packaging of said devices in a manner to insure against their coming in contact with any moisture during shipping and storage.

Free water detector pads embody a chemical substance which is reactive in the presence of moisture, to indicate such condition. In order for such pads to retain their effectiveness it is essential that they be kept in an absolutely dry environment until the occasion of their use.

For the purpose of insuring this, the pads are packaged by placing unit quantities in small metal containers or cans, which can be sealed by air-tight covers which have rim portions that interfit with the can rims. Such metal containers are most commonly used for holding paints, lacquers etc. as well as certain foodstuffs.

It is a usual procedure, when packaging a product which is sensitive to the environment, to provide the desired atmospheric conditions in the area where the actual capping or closing of the package or container is effected. This often involves bulky and expensive equipment, and the use of special atmosphere-controlled rooms or areas to obtain the desired result, i.e. maintain the integrity and effectiveness of the product.

SUMMARY

The above drawbacks of prior procedures and equipment are obviated by the present invention, and one object of the invention is to provide an extremely simple and inexpensive, improved means for subjecting partially packaged free water detector pads to a secondary drying operation just prior to the actual sealing of the package or container.

Another object of the invention is to provide an improved means for effecting a secondary drying operation as above, which is especially effective in insuring that the detector pads are entirely free of any moisture, and in maintaining such condition during their shipping and storage.

A still further object of the invention is to provide improved, secondary drying equipment in accordance with the foregoing, which is relatively small in size and compact yet has a large capacity to handle an appreciable production quantity of the product.

Yet another object of the invention is to provide an improved secondary dryer for free water detector pads, which can be used in the ordinary environment of production equipment, and which does not necessitate a special, dry-air room, nor special conditions different from those that are usually prevalent.

A feature of the invention is the provision of a secondary dryer as above characterized, which is economical of energy.

Still other features and advantages will hereinafter appear.

In accomplishing the foregoing the invention provides an electrically-heated drying oven that is especially arranged to subject open containers of water detector pads to a secondary drying operation. The oven is in the form of an elongate enclosure which provides a pair of elongate channels disposed side by side and having open outer-most ends and blind inner-most ends. The channels extend from one end of the enclosure where they are open, to a point located adjacent the other end of the enclosure, where they are blind.

Electric heating elements are located within the enclosure to expel moisture therefrom.

The channels have tracks with which the containers are engageable and along which they can travel, one of said channels being adapted to hold a plurality of said containers in single file whereby the containers can be moved along said channel from the open end thereof to the blind end thereof by a pushing force. To effect such travel, a powered pushing device comprising an air cylinder and lever arrangement is provided, for applying force to the end container at the channel opening.

The other of the channels of the enclosure is of greater width than the first channel and is adapted to accommodate a plurality of said containers in at least double file. In the enclosure a transfer structure is provided, in the form of a curved track, which interconnects the blind ends of the channels and provides for transfer of said containers from the narrower channel to the wider channel whenever the powered pushing means operates to advance the containers along the single-file channel.

A blower mounted at the top of the enclosure effects a circulation of air within the same, and directs a blast of air directly into the openings of the containers to insure a good drying action on the pads.

Figure 1:
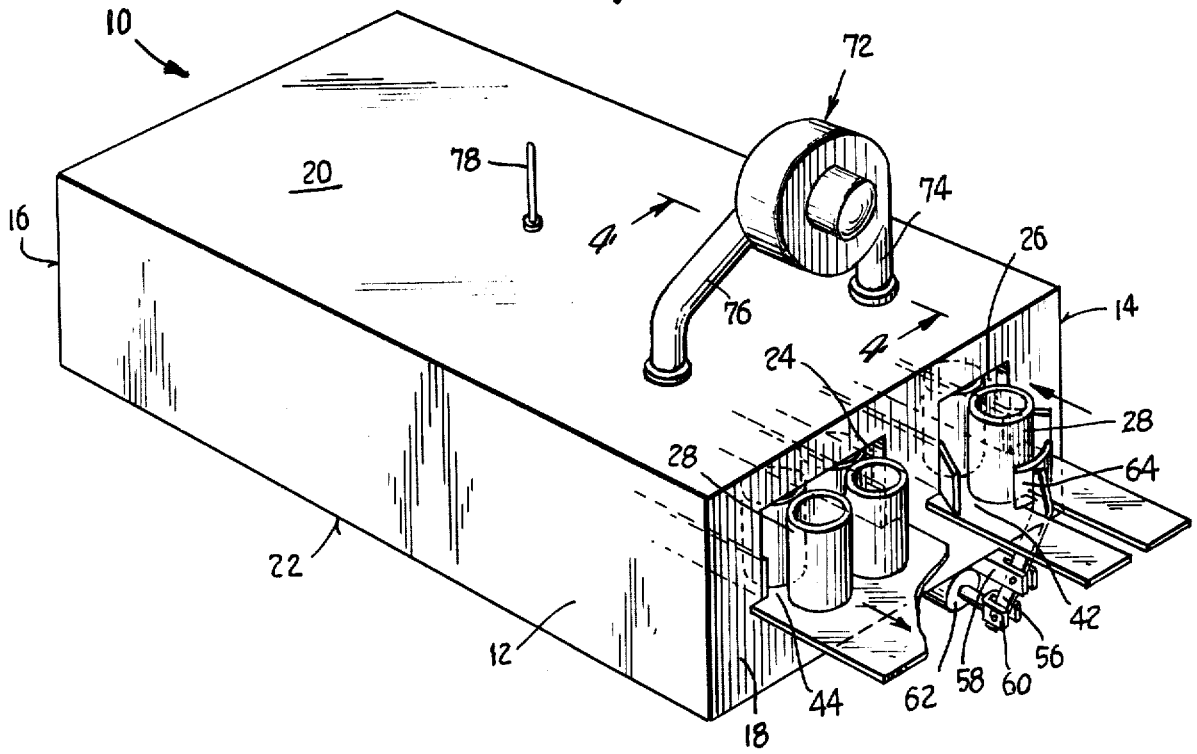
FIG. 1 is a perspective view of the improved secondary dryer oven of the invention.
Figure 2:
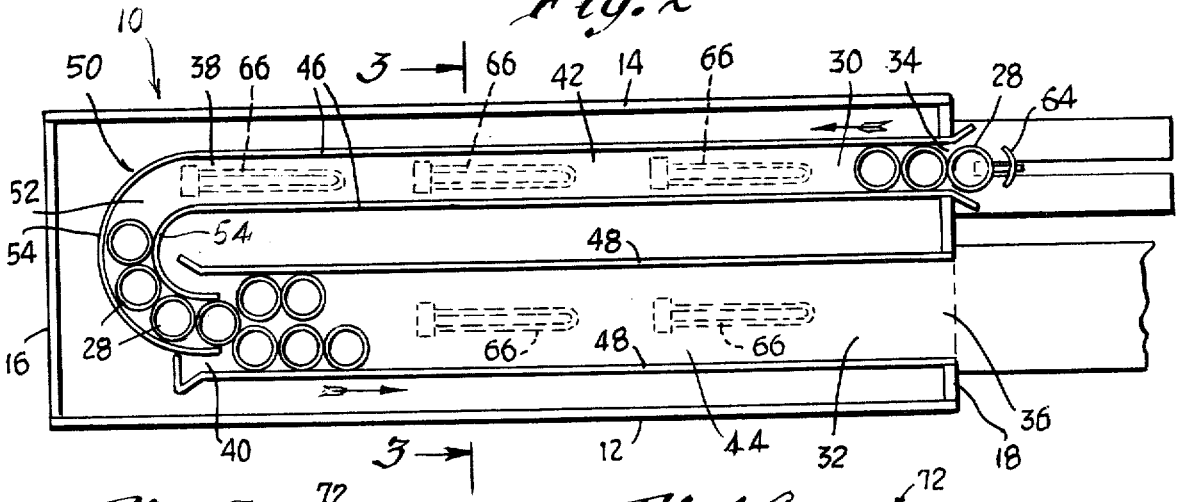
FIG. 2 is a top plan view of the oven with the top wall removed to reveal interior details.

Referring first to FIGS. 1 and 2, the improved drying oven as provided by the present invention comprises an elongate enclosure generally designated by the numeral 10, having side walls 12, 14; end walls 16, 18; and a top wall 20 and bottom wall 22. In the end wall 18 two openings 24, 26 are provided, the latter opening having a size to receive one at a time open-top metal containers 28 such as tin cans, in which packaged water detector pads have been placed.

In accordance with the invention, the opening 24 in the end wall 18 is larger than the opening 26 and can accommodate two such containers 28 disposed abreast or in double file.

The enclosure 10 has a pair of elongate horizontal channels 30, 32 disposed side by side, the channel 32 in accordance with the invention being at least twice as wide as the channel 30, said channels having open outer-most ends 34, 36 respectively, and blind inner ends 38, 40 respectively. The channels 30, 32 have tracks comprising portions 42, 44 respectively of a floor plate 45, and pairs of side rails 46, 48 respectively. The said tracks constitute guides which are engageable by the containers 28 whereby the latter can travel along and through the channels 30, 32.

At the blind ends 38, 40 of the channels 30, 32 a curved transfer structure 50 is provided, comprising a curved portion 52 of the floor plate 45 and a pair of 180° curved side rails 54. The side rails 54 and floor plate portion 52 together constitute a U-shaped guide as viewed from the top, by which a transfer is effected of the containers 28 from the blind end 38 of the channel 30 to the blind end 40 of the channel 32.

For the purpose of propelling the containers 28 through the channels 30, 32 and more specifically to propel the single file of containers 28 inward into the enclosure 10 along the channel 30 (thereafter outward from the enclosure 10 along the wide channel 32) there is provided a powered pushing device comprising a lever 56 which is pivotally mounted on a bracket 58 and at one end connected to a plunger 60 of an air cylinder 62. The other end of the lever 56 has a curved shoe 64 adapted to loosely fit against the sidewall of a container 28 as shown in FIGS. 1 and 2. When the air cylinder is activated, it causes the curved shoe 64 to advance from right to left, first engaging the end one of the containers 28 and then pushing the same into the channel 30 and advancing all of the containers in said channel one step, from right to left as viewed in FIGS. 1 and 2. Such advance also effects a transfer of a container 28 at the transfer structure 50, to deposit the same randomly into the wide channel 32.

Figure 3:
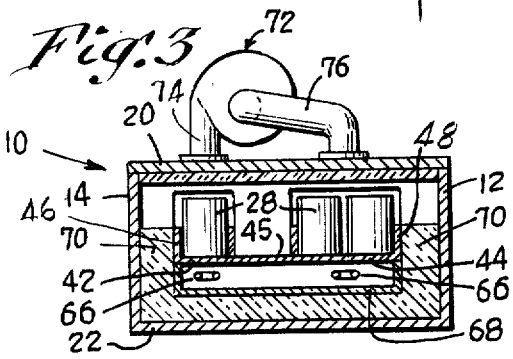
FIG. 3 is a transverse section taken on the line 3—3 of FIG. 2.
Figure 4:
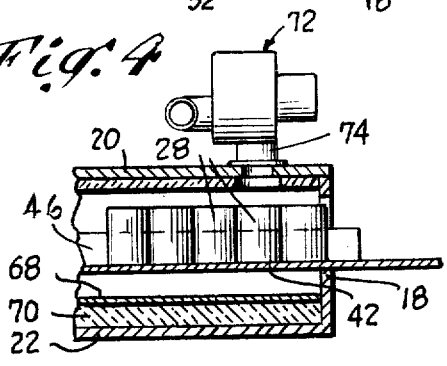
FIG. 4 is a fragmentary vertical section, taken on the line 4—4 of FIG. 1.

Means are provided to heat the interior of the enclosure 10, as by providing sheathed electrical heaters 66 disposed under the floor plate 45, specifically under the floor portions 42, 44 of the channels. Such heaters are disposed in the space located under the floor plate 45 and above a metal tray 68 which is located under the floor plate. Heat insulation 70 is disposed in the lower portion of the enclosure 20, between the side and bottom walls thereof and the assemblage of tracks and heaters, all as seen in FIGS. 3 and 4.

The provision of the wider channel 32, which is at least twice as wide as the channel 30, constitutes an important feature of the invention since it provides for a greater dwell time in a given enclosure size, enabling the storage and transporting of a larger number of the container 28 than is possible if the channel 32 were only as wide as the channel 30. Therefore, the enclosure 10 can at any moment hold a much greater number of the containers 28 for its particular size, with a longer drying period whereby a better heat treatment and drying-out is had than if the discharge channel 32 only held a single file of containers.

The invention also provides a blower 72 having a discharge pipe 74 and an intake pipe 76. The discharge pipe 74 of the blower is located to be positioned directly above one of the entering containers 28 in the single file of the channel 30, as shown in FIG. 4. Thus, a blast of air can be directed at the open top of this underposed container, which then receives the full benefit of the heated air to initiate an effective drying-out of the container contents. The intake pipe 76 of the blower receives heated air from the interior of the enclosure 10 as can be understood.

A thermometer 78 is provided in the top wall 20 of the enclosure 10, to indicate the interior temperature.

It will now be seen from the foregoing that I have provided an extremely simple, yet effective and unique drying oven which can advantageously function as a secondary dryer for removing any residual moisture from water detector pads which are packaged in containers, such as the container 28. Each time after the operator actuates the air cylinder 62 to advance the containers 28, the pad 64 is automatically retracted to provide clearance whereby another container 28 can be set in place, for transportation into the oven. The construction is simple and straight-forward, and I have found that no clogging or jamming of the containers 28 will occur in the wider channel 32 but instead such containers will be reliably shifted for ultimate discharge, by the containers emerging from the transfer structure 50.

Variations and modifications are possible without departing from the spirit of the invention.

I claim:

1. A drying oven for subjecting open containers of water detector pads to a secondary drying operation, comprising in combination:

(a) an elongate enclosure providing a pair of elongate channels disposed side by side and having open outer-most ends and blind inner-most ends, (b) said channels extending from one end of the enclosure where they are open, to a point located adjacent the other end of the enclosure where they are blind, (c) means providing heat to raise the temperature within the enclosure and to expel moisture therefrom, (d) said channels having tracks with which the containers are engageable and along which they can travel, (e) one of said channels being adapted to hold a plurality of said containers in single file whereby the containers can be moved, starting from an at-rest position, along said channel from the open end thereof to the blind end thereof by a pushing force, (f) means including a powered pushing device for providing said pushing force to the end one of said containers of said single file at the open outer-most end of said one channel, thereby to advance all of the containers of the single file toward the blind end of the channel, and (g) a 180° stationary transfer guide structure comprising spaced-apart opposed walls interconnecting the blind ends of the channels, providing for transfer of said containers from the said one channel to the other channel at the said blind ends in response to the pushing of the said powered pushing device.

2. The invention as defined in claim 1, wherein:

(a) the heat-providing means is disposed within the said enclosure, in good heat-exchanging relation with the spaces defined by the channels.

3. The invention as defined in claim 2, wherein:

(a) the heat-providing means is disposed under the said channels.

4. The invention as defined in claim 1, and further including:

(a) a blower mounted on the enclosure, for circulating the air therein.

5. The invention as defined in claim 4, wherein:

(a) the blower has an exhaust located to blow air into at least one open container for the at-rest positions of the containers in said one channel.

6. The invention as defined in claim 4, wherein:

(a) the blower has an intake communicating with the interior of the enclosure.

7. The invention as defined in claim 1, wherein:

(a) said tracks comprise rails extending along opposite sides of the channels.

8. The invention as defined in claim 1, wherein:

(a) the transfer structure comprises a curved side rail extending between the blind ends of the channels.

9. The invention as defined in claim 3 and further including:

(a) heat insulation disposed under the heat-providing means and along opposite sides thereof.

10. The invention as defined in claim 1, wherein:

(a) the said other channel is adapted to hold a plurality of said containers in double file.

11. The invention as defined in claim 1, wherein:

(a) the pushing device comprises an air cylinder and piston, and (b) means for transferring force from the piston to the said end one of said containers.

12. The invention as defined in claim 1, wherein:

(a) the other of said channels is of greater width than the said one channel and is adapted to accommodate a plurality of said containers in at least double file.

* * * * *